US008539743B2

(12) United States Patent
Rapparini

(10) Patent No.: US 8,539,743 B2
(45) Date of Patent: Sep. 24, 2013

(54) MACHINE FOR PACKAGING IN CAPSULES, ALSO IN VACUUM AND/OR CONTROLLED ATMOSPHERE

(75) Inventor: Gino Rapparini, Bologna (IT)

(73) Assignee: Aroma Systems, SRL, Bologna (IT)

( * ) Notice: Subject to any disclaimer, the term of this patent is extended or adjusted under 35 U.S.C. 154(b) by 0 days.

(21) Appl. No.: 12/450,930

(22) PCT Filed: Sep. 25, 2007

(86) PCT No.: PCT/IB2007/002779

§ 371 (c)(1),
(2), (4) Date: Feb. 24, 2010

(87) PCT Pub. No.: WO2008/129350

PCT Pub. Date: Oct. 30, 2008

(65) Prior Publication Data

US 2011/0016834 A1 Jan. 27, 2011

(30) Foreign Application Priority Data

Apr. 24, 2007 (IT) ..... BO2007A0303

(51) Int. Cl.
*B65B 47/00* (2006.01)

(52) U.S. Cl.
USPC ..... 53/561; 53/511; 53/559; 53/122

(58) Field of Classification Search
USPC ..... 53/79, 86, 87, 88, 122, 128.1, 134.2, 53/281, 511, 559, 561; 206/5
See application file for complete search history.

(56) References Cited

U.S. PATENT DOCUMENTS

| | | | | |
|---|---|---|---|---|
| 1,895,899 | A * | 1/1933 | Schaub | 53/450 |
| 3,218,776 | A * | 11/1965 | Cloud | 53/453 |
| 3,675,390 | A * | 7/1972 | Austin | 53/282 |
| 4,754,785 | A | 7/1988 | Eisenberg | 141/1 |
| 4,870,800 | A * | 10/1989 | Kasai | 53/88 |
| 5,012,629 | A * | 5/1991 | Rehman et al. | 53/453 |
| 5,121,588 | A * | 6/1992 | Abate | 53/375.9 |
| 7,237,371 | B2 * | 7/2007 | Yamamoto et al. | 53/433 |
| 2006/0207619 | A1 * | 9/2006 | Conti | 131/322 |
| 2006/0254218 | A1 * | 11/2006 | Yamamoto et al. | 53/433 |
| 2007/0017825 | A1 | 1/2007 | Rapparini | 206/5 |

FOREIGN PATENT DOCUMENTS

| | | |
|---|---|---|
| CN | 2567152 Y | 8/2003 |
| GB | 1427375 | 3/1976 |
| NL | 6905814 | 10/1970 |
| WO | WO 01/40084 | 6/2001 |
| WO | WO 2005120957 | 12/2005 |

* cited by examiner

*Primary Examiner* — Alexandra Elve
*Assistant Examiner* — Eyamindae Jallow
(74) *Attorney, Agent, or Firm* — Fattibene and Fattibene LLC; Paul A. Fattibene

(57) ABSTRACT

Machine for packaging in capsules, also in a vacuum and/or in a controlled atmosphere, characterized by the fact that a cylindrical wheel (G) with horizontal axis (R), peripherally provided with rows (S) of cavities (A), parallel to said axis (R) and angularly equally distanced by the step (P), preset to be interchangeably equipped with molds (F,-F') having different formats and geometrically congruent to the format of the capsules to be used (C; C).

12 Claims, 9 Drawing Sheets

MACHINE FOR PACKAGING IN CAPSULES, ALSO IN VACUUM AND/OR CONTROLLED ATMOSPHERE

FIELD OF THE ART

The present invention refers to the technology for automatic packaging machines. In particular, the invention concerns a machine to fill capsule with hydro-soluble products of infusion products to obtain hot beverages. International Classification B65 d.

STATE OF THE ART

Machines to package hot beverages or machines to fill and close capsules containing hydro-soluble products or infusion products to obtain hot beverages are well known.

Currently, to package capsule containing hydro-soluble products or infusion products to obtain hot beverages the market requires machines to operate at very high productions rhythms.

The problem to be solved is exactly to realize machines, to package capsules at very high hourly productivity, very reliable and even versatile to easily change both the capsule format and their structure, and in particular the structure of the closing diaphragms, either filtering or hermetic.

Besides the abovementioned problems, the present invention solves the problem of packaging sealed hermetic capsules both in a vacuum and/or in a controlled atmosphere.

DESCRIPTION

The invention is now disclosed with specific reference to the figures of the drawings, which have been attached as un unbinding example.

Figure 1:
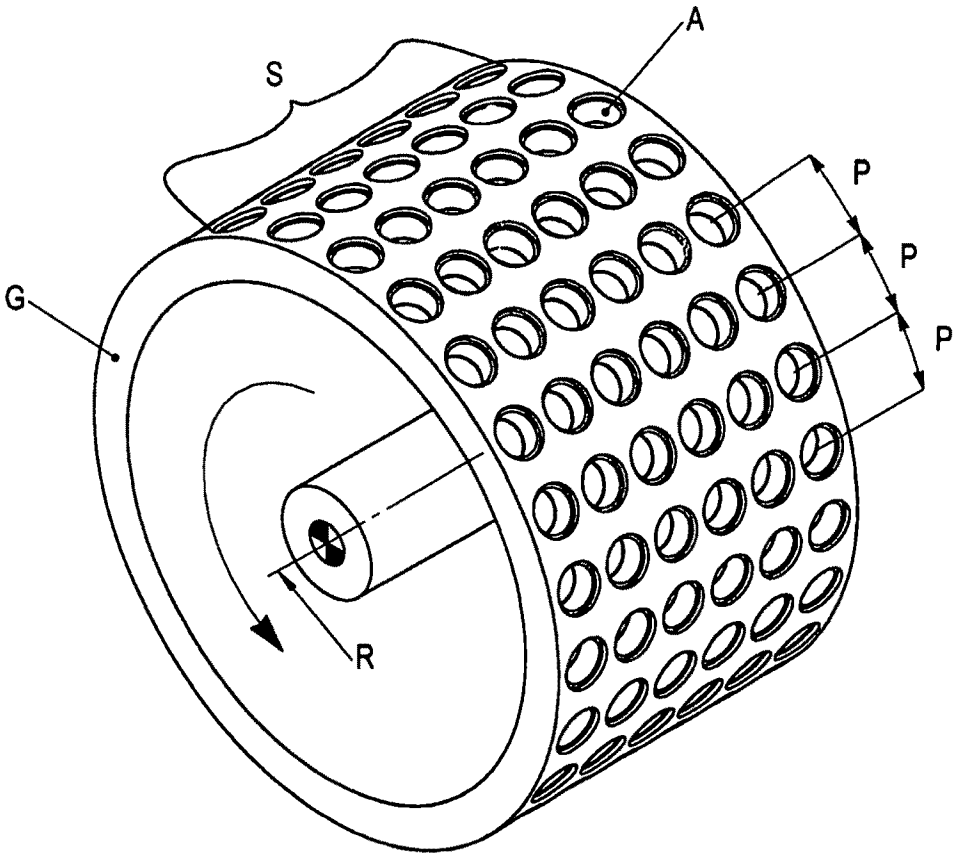
FIG. 1 shows in axonometric view a cylindrical wheel (G) with horizontal axis, peripherally provided with rows (S) parallel and angularly equally distant at the step (P) of cavities (A) placed to be interchangeably equipped with moulds having different formats geometrically congruent to the format of the capsules to be packaged.
Figure 2:
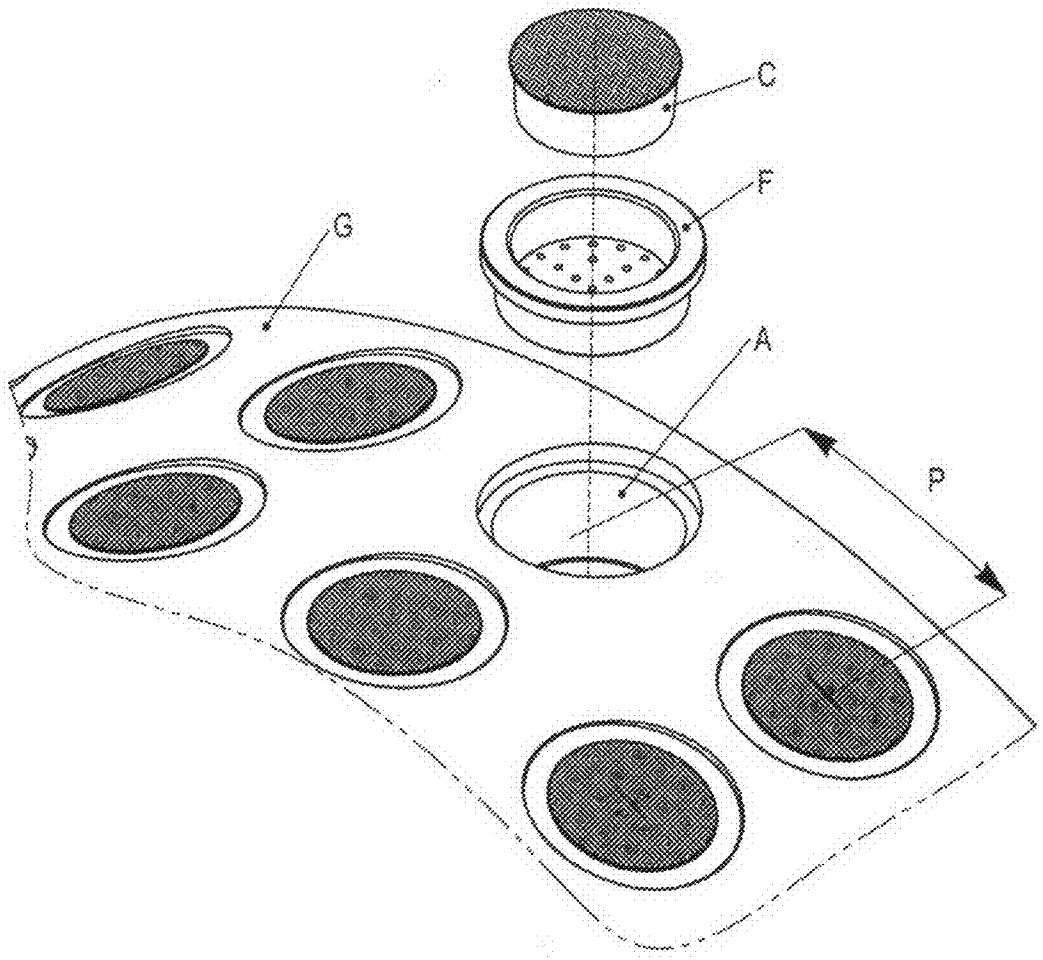
FIG. 2 is a partial axonometric view that highlights the positioning of each cavity (A) of the relative mould (F) geometrically congruent to the format of the capsule (C) filled and closed on the wheel (G) of the packaging machine that is object of the present invention.
Figure 3:
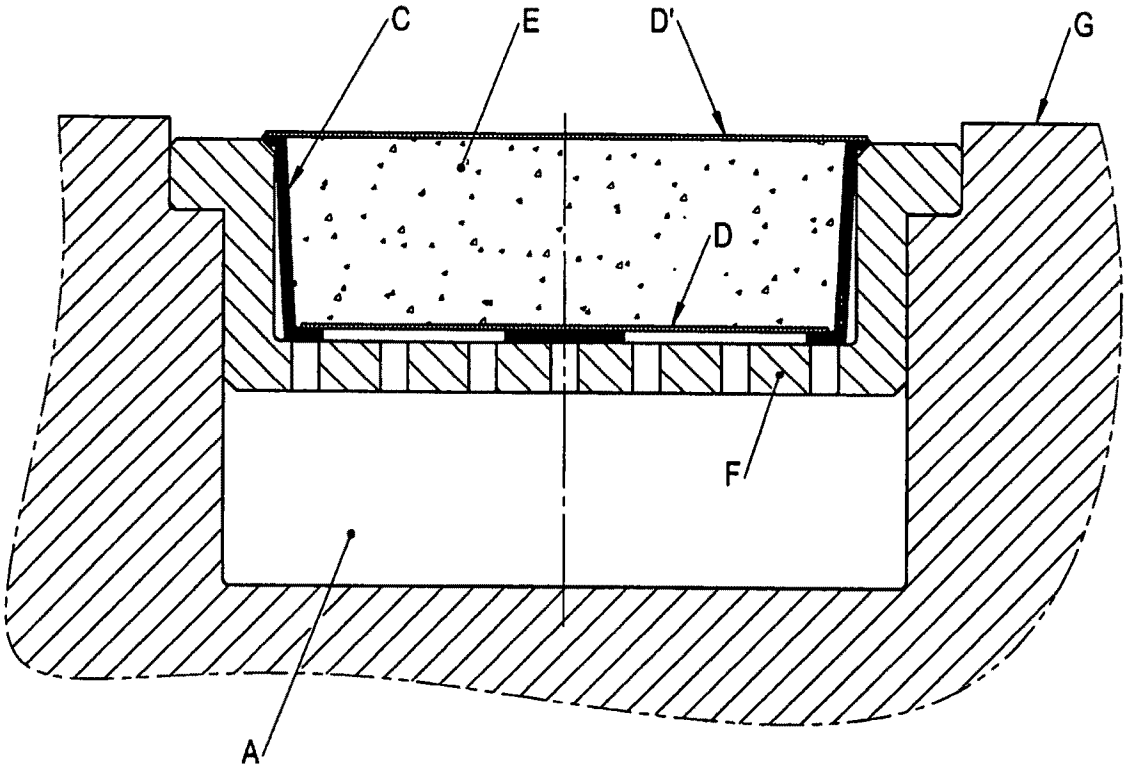
FIG. 3 shows in section a single cavity (A) of the wheel (G) set up with a mould (F) inside which has already been placed a capsule (C) filled with the product (E) closed inferiorly and superiorly with filtering diaphragms (D; D').
Figure 4:
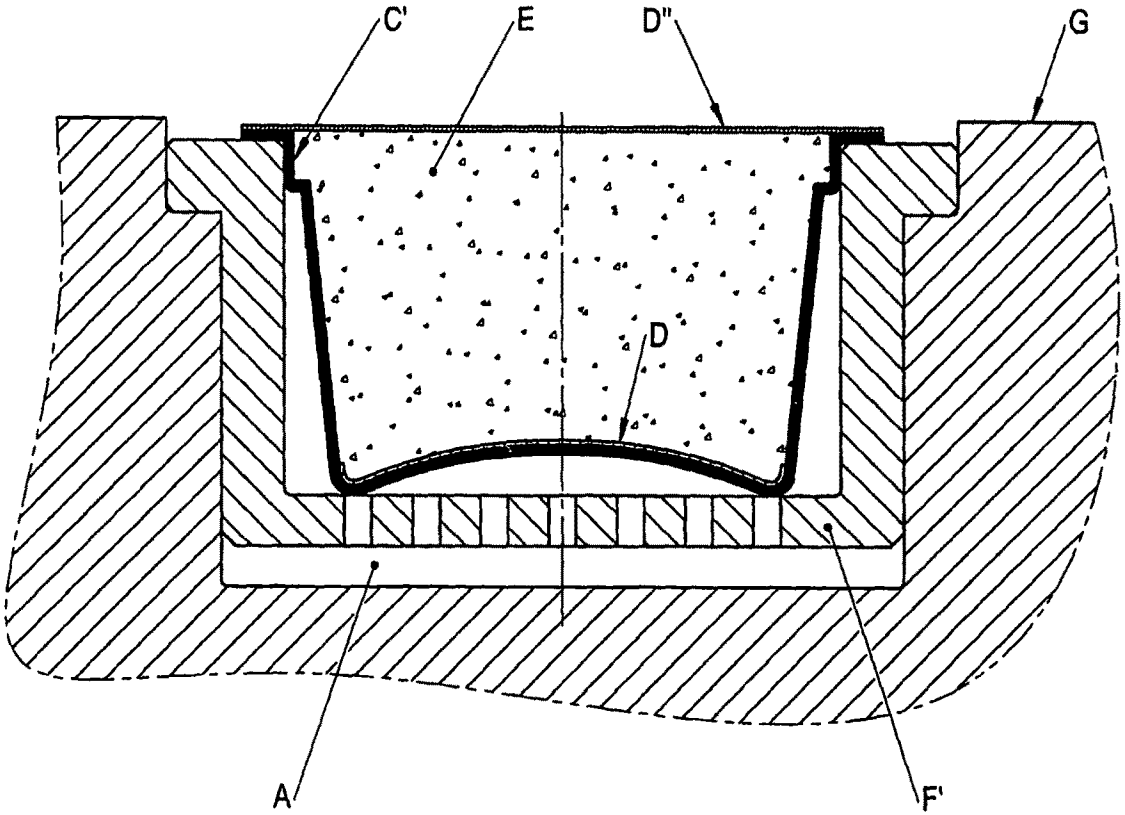
FIG. 4 shows in section a cavity (A) inside which has already been inserted a mould (F') geometrically fit for the insertion of a capsule (C') of different structure and format. It can be noticed the application of the hermetic diaphragm (D") and of the filtering diaphragm (D).
Figure 5:
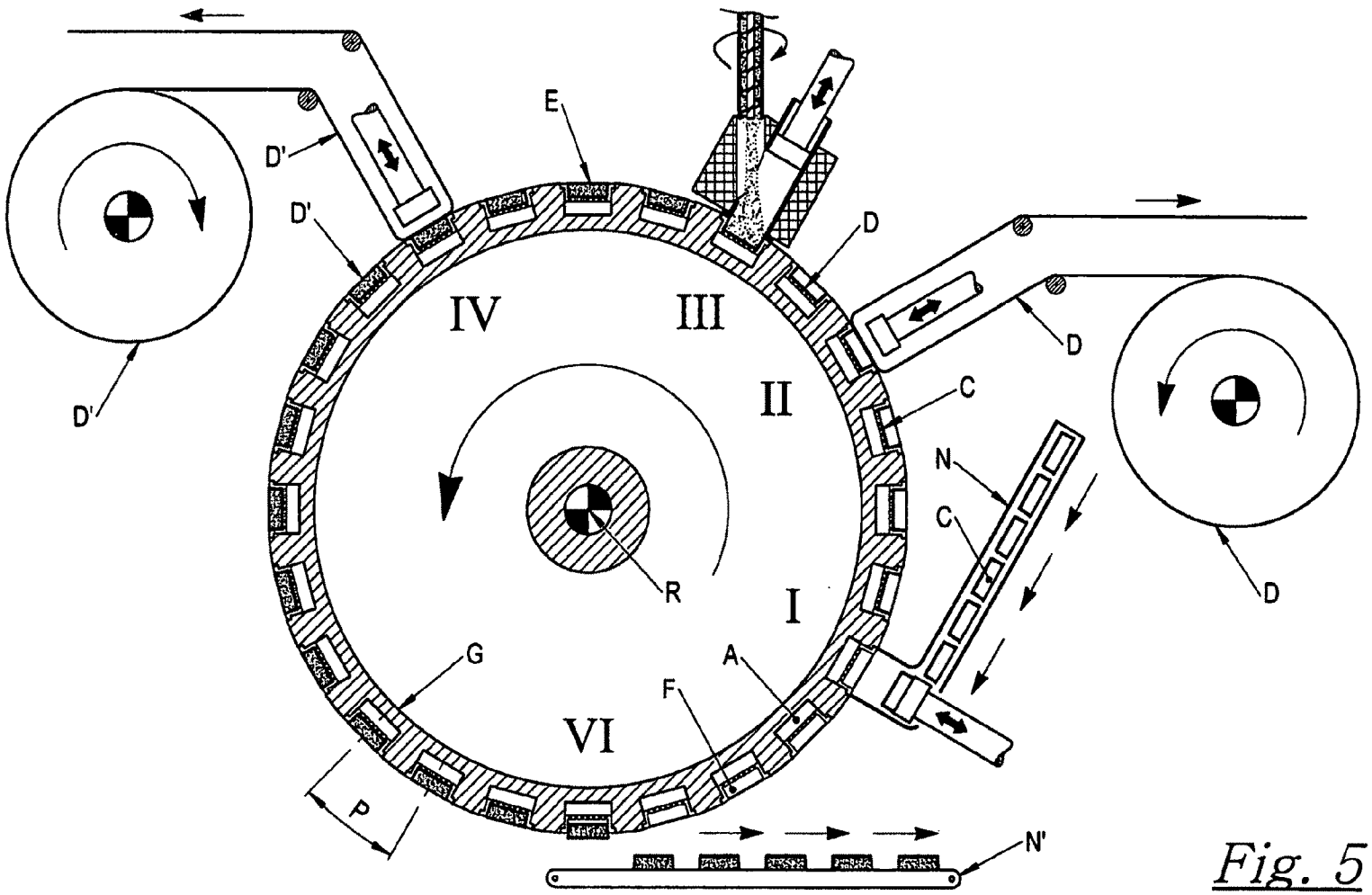
Figure 6:
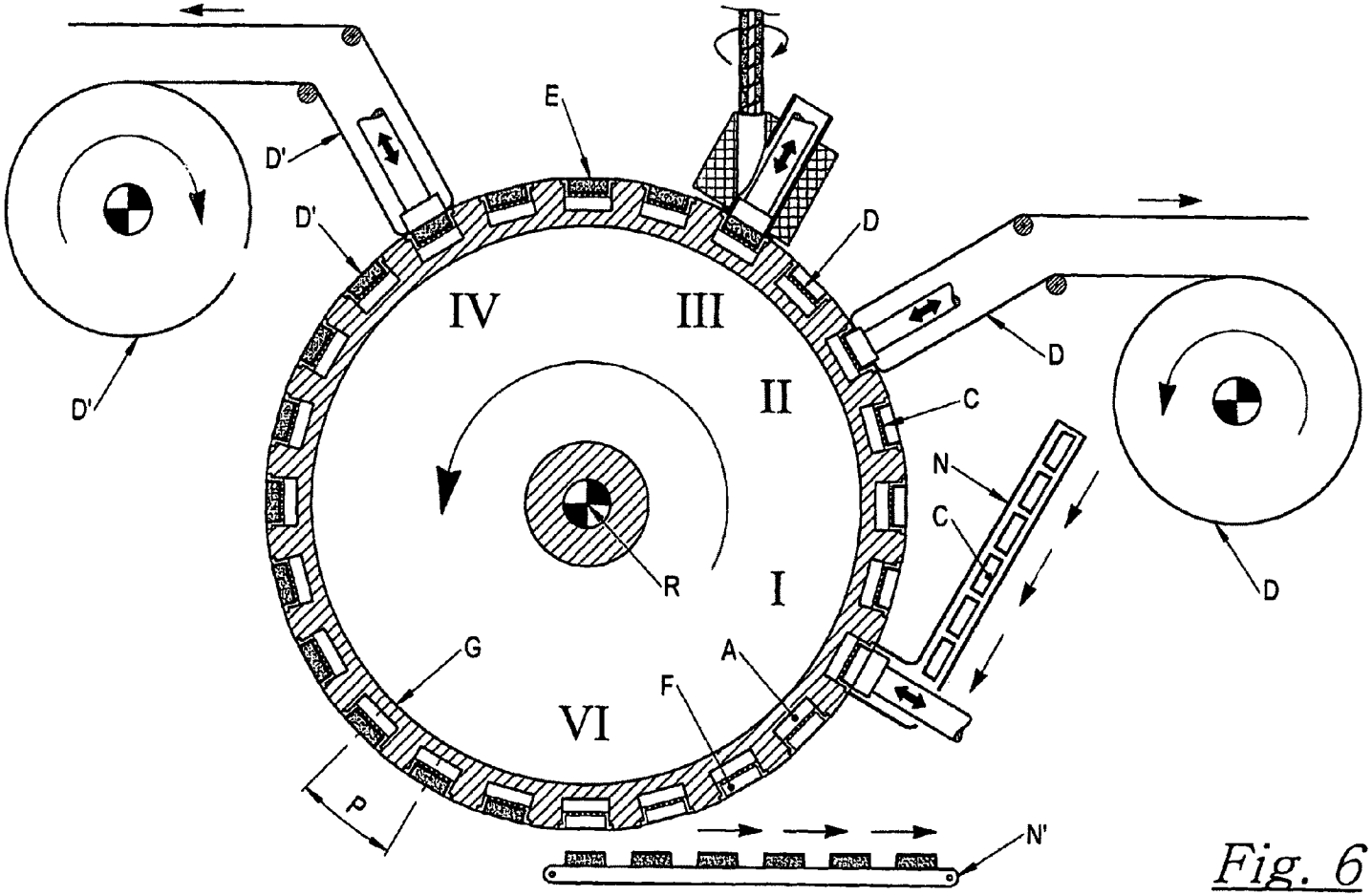

FIG. 5 and FIG. 6 show schematically an entire packaging process of the capsules (C), of which are indicated two subsequent phases realized in sequence in their respective operational stations (I; II; III; IV; VI).

Figure 7:
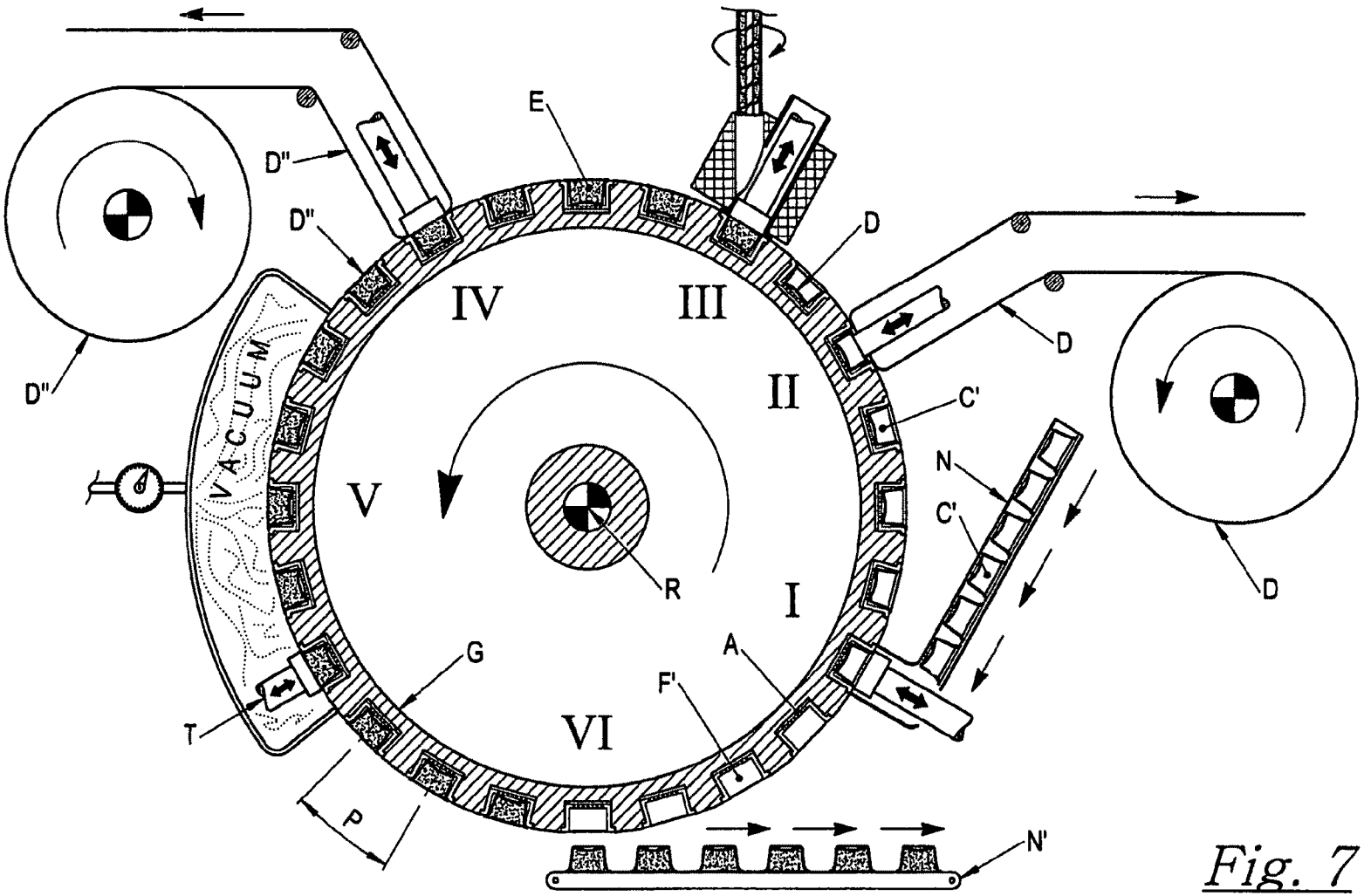

FIG. 7 shows the application of a bell provided with an pump equipment that makes the vacuum (VACUUM) inside the capsules (C'). It can be noticed the presence of a thermo-sealing vacuum device (T).

Figure 8:
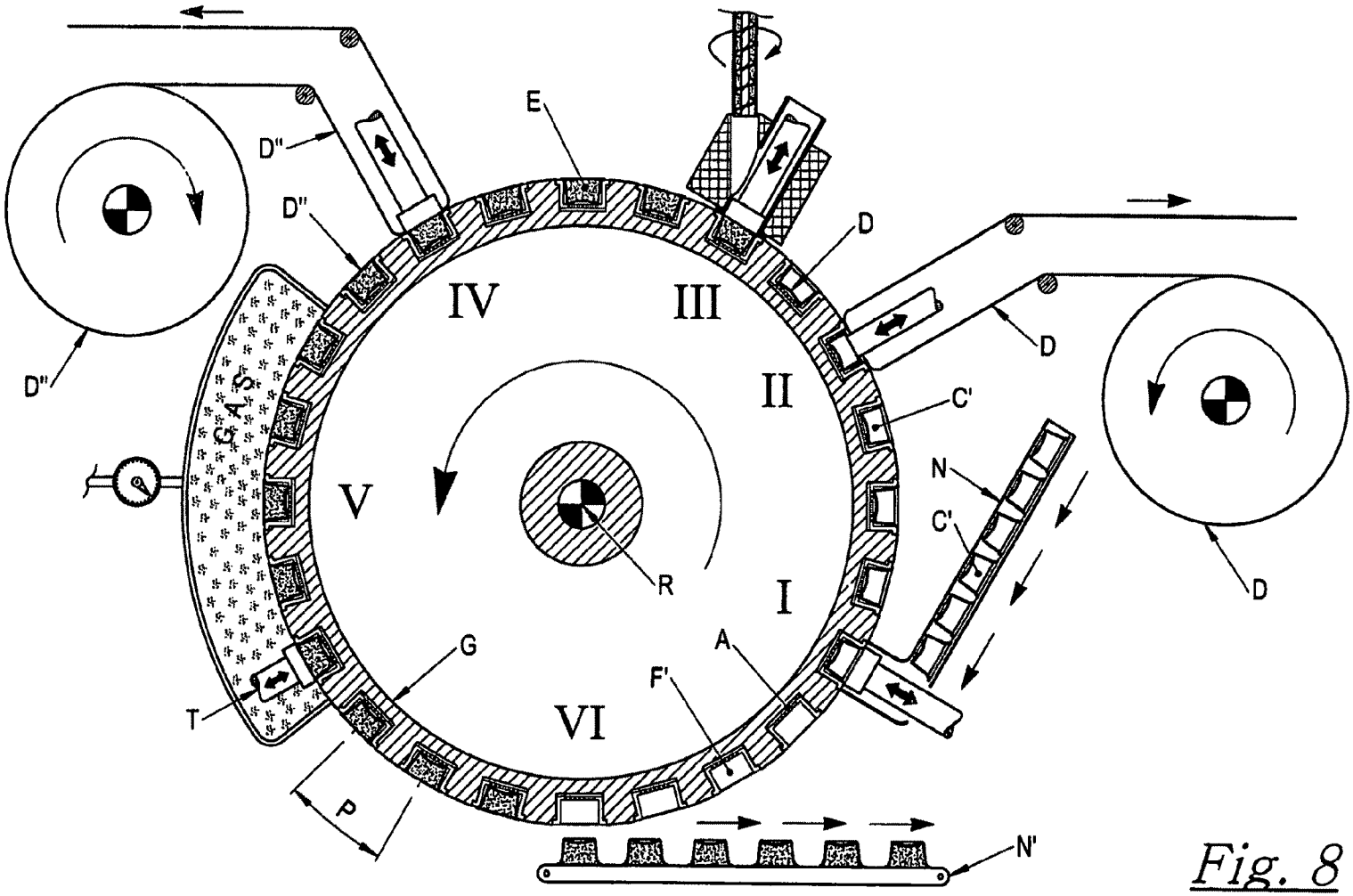

FIG. 8 is similar to FIG. 7 but the bell is filled with GAS.

Figure 9:
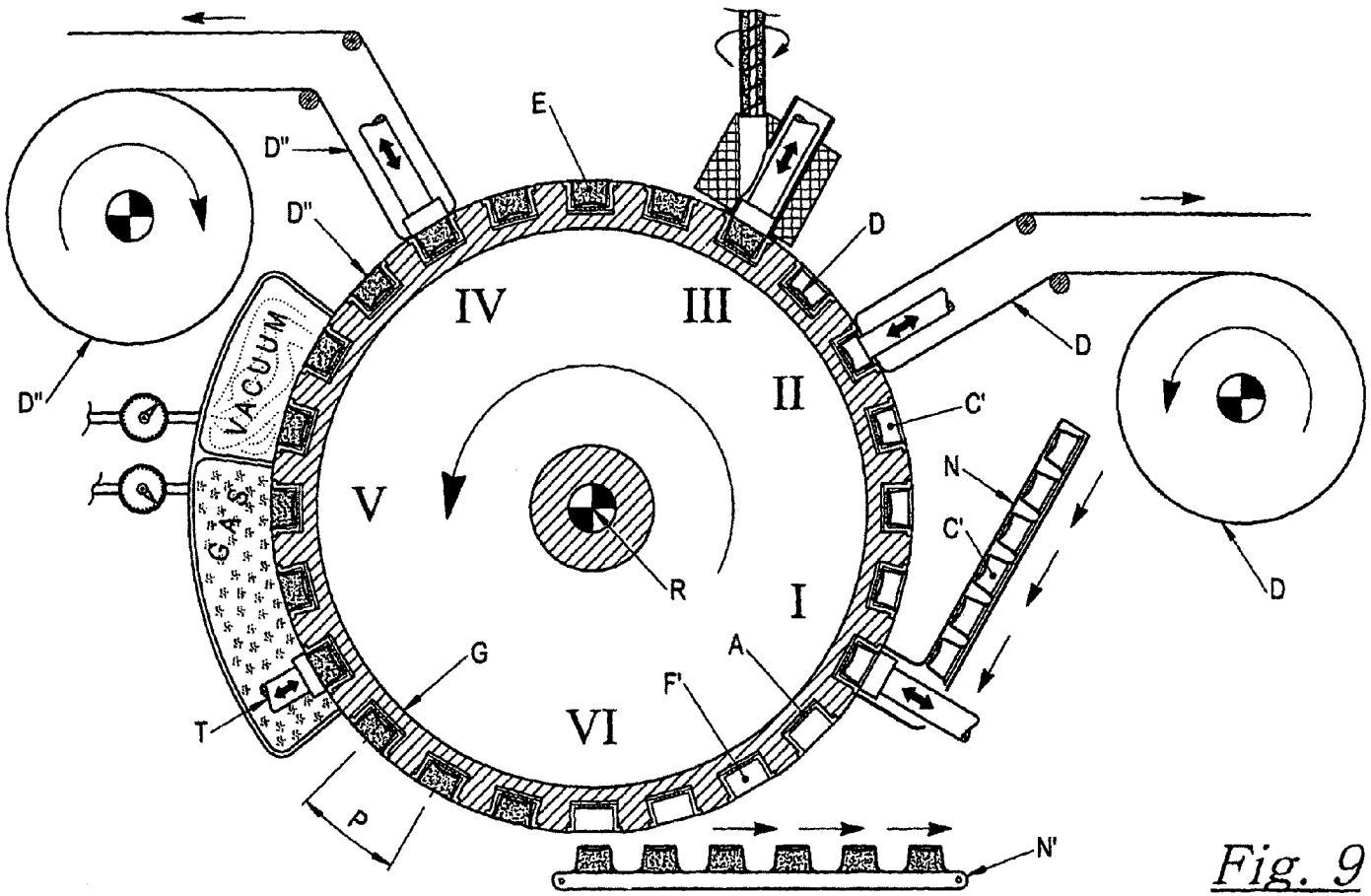

FIG. 9 is similar to FIGS. 7 and 8 but the bell has two compartments (VACUUM/GAS).

In the figures each single detail is marked as follows:

A indicates the cavities placed on the cylindrical mantle of the wheel with horizontal axis.

C is a capsule for hydro-soluble or infusion products with the pierced bottom.

C' is a capsule of different format with the bottom not yet pierced.

D indicates a filtering diaphragm applied on the inside wall of the bottom of the capsule (C; C').

D' indicates a diaphragm applied on the upper wall of the capsule (C) containing the infusion product (E).

D" indicates an hermetic film applied on the capsule (C") of different structure and format.

E indicates loose product introduced inside the capsules (C; C').

F indicates a mould that is geometrically congruent with the format of the capsule to be filled of format (C).

F' indicates a mould fit for the insertion of a capsule of different geometry (C').

G indicates a cylindrical wheel with horizontal axis.

N indicates a feeding devices of the coming empty capsules.

N' indicates a conveyer belt transporting the completed capsules.

P is the circumference step of the parallel rows (S) of cavities (A).

R indicates the horizontal rotation axis of the wheel (G).

S indicates rows of cavities parallel to the rotation axis (R).

T indicates a thermo-sealing devices.

VACUUM/GAS indicate a bell under vacuum or controlled atmosphere.

The clearness of the figures highlights the simplicity of the proposed solutions. It is obvious that in practice the realization fashions will allow several variations of practical realization both for the dimensioning and the structural proportioning of the various components and for the building materials according to the specific technologies. It is also evident that the operational and functional components such as cinematic devices for their actuation could be realized with different technological choices.

All the machines for the packaging of capsules, in a vacuum and/or in controlled atmosphere, that will present the innovative features such as basically described, illustrated and hereinafter claimed, will be included in the protection sphere of the prevent industrial invention.

The invention claimed is:

1. Machine for the packaging of capsules, also in a vacuum and/or in a controlled atmosphere, comprising:

a cylindrical wheel (G) with horizontal axis (R), peripherally provided with rows (S) of cavities (A) integrally formed thereon, said rows (S) being parallel to said axis (R) and angularly equally distanced by a step (P), said rows (S) of cavities (A) being preset to be interchangeably equipped with moulds (F; F') having different formats and geometrically congruent to the format of the capsules to be packaged (C; C'), wherein cavities of the rows of cavities (A) are provided with a cavity depth forming a bottom inner surface of the cavity and a ledge adapted to support the moulds (F; F'), the ledge dividing the cavities into an upper portion and a lower portion, the upper portion having a larger diameter than the lower portion and wherein the moulds have an external mould depth less than that of the cavity depth of the cavities forming a bottom outer surface of the moulds, wherein a space is provided in the cavities between the bottom outer surface of the moulds and the bottom inner surface of the cavity to accommodate moulds having different external mould depths, whereby the ledge securely holds the moulds elevated within a cavity permitting moulds having different external depths to be securely held within a cavity and yet facilitating easy interchangeability.

2. Machine for the packaging of capsules, also in a vacuum and/or in a controlled atmosphere, as in claim 1, wherein:

in proximity of a first station (I) said wheel (G) is fed by empty capsules (C) coming from a feeding device (N).

3. Machine for the packaging of capsules, also in a vacuum and/or in a controlled atmosphere, as in claim 2, wherein:

in proximity of a second station (II) empty capsules are provided with a filtering diaphragm (D) cut and simultaneously thermo-sealed inside on the bottom of each of the empty capsules (C).

4. Machine for the packaging of capsules, also in a vacuum and/or in a controlled atmosphere, as in claim 3, wherein:

in proximity of a third station (III) the empty capsules are filled with hydro-soluble or infusion products (E).

5. Machine for the packaging of capsules, also in a vacuum and/or in a controlled atmosphere, as in claim 4, wherein:

in the fourth station (IV) one of the capsules (C) filled with the product (E) is cut and simultaneously thermo-sealed with a filtering diaphragm (D').

6. Machine for the packaging of capsules, also in a vacuum and/or in a controlled atmosphere, as in claim 4, wherein:

in the fourth station (IV) one of the capsules (C') is cut and simultaneously partially thermo-sealed with an hermetic film (D").

7. Machine for the packaging of capsules, also in a vacuum and/or in a controlled atmosphere, as in claim 6, wherein:

in a fifth station (V) at least one or more rows of capsules already filled and partially closed by the hermetic film (D") transit under a bell in depression inside which operate thermosealing devices (T) that seal the capsules (C; C') under vacuum (VACUUM) or under controlled atmosphere (GAS).

8. A machine for the packaging of capsules comprising:

a wheel having an axis;

a plurality of cavities forming rows, the rows being parallel to the axis, each cavity of said plurality of cavities having a cavity depth forming a bottom inner surface of the cavity and a ledge dividing the cavity into an upper portion and a lower portion, the upper portion having a larger diameter than the lower portion;

a mold adapted to removably fit within at least one of said plurality of cavities, said mold having an external mold depth less than that of the cavity depth of each of said plurality of cavities forming a bottom outer surface of the mold wherein a space is provided in the at least one of said plurality of cavities between the bottom outer surface of the mold and the bottom inner surface of the cavity to accommodate molds having different external mold depths and having a geometrically congruent shape of a capsule and a flange adapted to fit within the ledge, whereby capsules of different structure and format may be used and held within each cavity of said plurality of cavities without modification to the cavity;

a capsule insertion operational station placed adjacent said wheel, whereby the capsule is inserted into at least one of said plurality of cavities;

a filter diaphragm insertion operational station placed adjacent said wheel, whereby a filter diaphragm is inserted into at least one of said plurality of cavities;

a product insertion operational station placed adjacent said wheel, whereby a product is inserted into at least one of said plurality of cavities;

a thermo-sealed filtering diaphragm insertion operational station placed adjacent said wheel, whereby a thermo-sealed filtering diaphragm is inserted into at least one of said plurality of cavities; and a thermo-sealing device placed adjacent said wheel, whereby the capsules are packaged at very high production rhythms.

9. A machine for the packaging of capsules as in claim 8 further comprising:

a vacuum bell placed over said thermo-sealing device.

10. A machine for the packaging of capsules as in claim 8 further comprising:

a gas bell placed over said thermo-sealing device.

11. A machine for the packaging of capsules as in claim 8 further comprising: a vacuum bell placed over a portion of said plurality of cavities; and a gas bell placed over said thermo-sealing device.

12. A machine for the packaging of capsules comprising:

a wheel having an axis;

a plurality of cavities forming rows, the rows being parallel to the axis, each cavity of said plurality of cavities having a cavity depth forming a bottom inner surface of the cavity and a ledge dividing the cavity into an upper portion and a lower portion, the upper portion having a larger diameter than the lower portion;

a mold adapted to removably fit within at least one of said plurality of cavities without any attachment to the bottom, said mold having an external mold depth less than that of the cavity depth of each of said plurality of cavities forming a bottom outer surface of the mold wherein a space is provided in the at least one of said plurality of cavities between the bottom outer surface of the mold and the bottom inner surface of the cavity to accommodate molds having different external mold depths and having a geometrically congruent shape of a capsule;

a flange formed on a perimeter of said mold adapted to fit within the ledge, whereby capsules of different structure and format may be used and held within each cavity of said plurality of cavities without modification to the cavity or attachment to the bottom inner surface of a cavity of said plurality of cavities;

wherein the flange of said mold is seated in the ledge and securely held therein without any attachment to the bottom inner surface of a cavity of said plurality of cavities, whereby said mold is removable merely by disengaging the flange from the ledge and molds having different external mold depths are easily interchangeable;

a capsule insertion operational station placed adjacent said wheel, whereby the capsule is inserted into at least one of said plurality of cavities;

a filter diaphragm insertion operational station placed adjacent said wheel, whereby a filter diaphragm is inserted into at least one of said plurality of cavities;

a product insertion operational station placed adjacent said wheel, whereby a product is inserted into at least one of said plurality of cavities;

a thermo-sealed filtering diaphragm insertion operational station placed adjacent said wheel, whereby a thermo-sealed filtering diaphragm is inserted into at least one of said plurality of cavities; and a thermo-sealing device placed adjacent said wheel, whereby the capsules are packaged at very high production rhythms.

* * * * *